US005167332A

United States Patent [19]

Schröter

[11] Patent Number: 5,167,332

[45] Date of Patent: Dec. 1, 1992

[54] FLEXIBLY MOUNTABLE STORAGE SYSTEM, AND A BRACKET AND A SUPPORTING PART FOR USE IN THIS SYSTEM

[75] Inventor: Klaus Schröter, Krefeld, Fed. Rep. of Germany

[73] Assignee: Bruynzel Monta Magazijn System B.V., NK Panningen, Netherlands

[21] Appl. No.: 511,637

[22] Filed: Apr. 20, 1990

[30] Foreign Application Priority Data

Apr. 21, 1989 [NL] Netherlands ..... 8901008

[51] Int. Cl.[5] ..... A47F 5/00

[52] U.S. Cl. ..... 211/187; 248/243

[58] Field of Search ..... 211/187, 190, 191; 248/243, 247, 248, 222.2, 222.3; 108/111, 144

[56] References Cited

U.S. PATENT DOCUMENTS

| | | | |
|---|---|---|---|
| 2,157,309 | 5/1939 | Swedman et al. | 248/243 |
| 2,760,650 | 8/1956 | Franks | 211/187 |
| 3,490,604 | 1/1970 | Klein | 211/191 |
| 4,421,239 | 12/1983 | Vargo | 211/187 |
| 4,898,286 | 2/1990 | Orlandi | 211/187 |

FOREIGN PATENT DOCUMENTS

| | | |
|---|---|---|
| 2484806 | 12/1981 | France . |
| 88/02446 | 4/1988 | PCT Int'l Appl. . |

*Primary Examiner*—Robert W. Gibson, Jr.
*Attorney, Agent, or Firm*—Weingarten, Schurgin, Gagnebin & Hayes

[57] ABSTRACT

The invention relates to a flexibly mountable storage system, comprising: at least one supporting part in which a mounting opening is provided at predetermined locations; at least one flat bracket adapted to be mounted in a mounting opening, said bracket comprising at least a first bracket portion, which serves to support an object to be mounted relatively to the supporting part; a second bracket portion, which in the operative position is arranged on the side of the supporting part that is away from the object; and a connecting portion, which connects the first bracket portion and the second bracket portion to each other. According to the invention a mounting opening (10) has at least two opening portions (11, 12), the first opening portion (11) serving to receive in the operative position the connecting portion (33) of the bracket (30) and having such shape and size that the bracket (30) has only slight vertical clearance in the operative position, and the second opening portion (12) being suitable for allowing the second bracket portion (32) to pass in an insertion position, the bracket (30) in the insertion position making an angle with the position of the bracket (30) in the operative position.

14 Claims, 4 Drawing Sheets

FLEXIBLY MOUNTABLE STORAGE SYSTEM, AND A BRACKET AND A SUPPORTING PART FOR USE IN THIS SYSTEM

The invention relates to a flexibly mountable storage system, comprising:

at least one supporting part in which a mounting opening is provided at predetermined locations;

at least one flat bracket adapted to be mounted in a mounting opening, said bracket comprising at least:

a first bracket portion, which serves to support an object to be mounted relatively to the supporting part;

a second bracket portion, which in the operative position is arranged on the side of the supporting part that is away from the object; and a connecting portion, which connects the first bracket portion and the second bracket portion.

Such a storage system is well known, in which in general vertical supporting parts are used. The term "flexible" in this connection means that the user is offered the possibility of mounting the objects, for example shelves or clothes racks, at a height of his own choice. The user determines in which of the mounting openings the brackets are to be mounted, and after the brackets have been mounted he mounts the object on the brackets.

In the known storage system with vertical supporting parts each of the mounting openings is formed as a rectangular slot whose longer side is vertically directed. The bracket is mounted by holding it in a vertical position, inserting the upper part of the second bracket portion through the mounting opening chosen, moving the bracket upwards while simultaneously inserting the lower part of the second bracket portion through the mounting opening, and finally moving the bracket downwards until the lower side of the connecting portion rests on the lower edge of the mounting opening. Thus, both the upper part and the lower part of the second bracket portion are positioned behind the vertical supporting part, so that the bracket can only be removed by repeating the above-mentioned movements in reverse order. The object to be supported, comprising a vertical engagement portion, can now be mounted on the supporting part via the bracket by positioning the engagement portion of the object by means of a downward movement between the supporting part and the upper part of the first bracket portion, the lower edge of the engagement portion of the object resting on the upper side of the connecting portion of the bracket.

A disadvantage associated with this known storage system is that when the object is being removed by means of an upward movement, the bracket may be moved upwards along with it, then move out of the mounting opening and fall. What plays a role here is the fact that in large-scale machine-manufacture it often happens there is a burr on the side of the engagement portion's bottom edge that is away from the supporting part. What plays a role, too, is the fact that when the object is being removed by means of an upward movement, it will also tilt. Thus, due to such a burr or to the tilt, the bracket may easily be displaced as well. This disadvantage will occur in particular when the object is distorted due to heavy loading and is thus wedged between the bracket and the supporting part.

A further disadavantage is that in order to allow the second bracket portion to be inserted, the vertical dimension of the mounting opening has to be larger than the sum of the vertical dimension of the connecting portion of the bracket and the vertical dimension of the lower part of the second bracket portion, which is a weakening of the supporting part. Since in view of the strength of the supporting part a minimal distance is required between the upper edge of a mounting opening and the lower edge of the mounting opening provided directly above it, this means a limitation of the flexibility of the storage system.

A further disadvantage associated with the large vertical dimension of the known mounting opening is the fact that for the second bracket portion to engage behind the supporting part above the mounting opening in the operative position of the bracket, the second bracket portion has to project relatively far above the connecting portion.

It is an object of the invention to provide a storage system of the above-mentioned type, in which it is impossible for the bracket to be displaced along with the object when the object is being removed.

It is a further object of the invention to provide a storage system of the above-mentioned type, in which the vertical dimension of the mounting openings is as small as possible.

Further, the invention aims to provide a storage system of the above-mentioned type, in which the minimally required vertical distance between the respective mounting openings is as small as possible.

To achieve these effects the mounting openings of a storage system of the above-mentioned type are formed, according to the invention, in such a way that they comprise at least two opening portions, the first opening portion serving to receive the connecting portion of the bracket in the operative position and having such form and size as to allow the bracket only limited vertical play in the operative position, the second opening portion being suitable for allowing the second bracket portion to pass in an insertion position, the bracket in the insertion position making an angle with the position of the bracket in the operative position.

If in the storage system according to the invention the bracket is to be removed it is necessary for the bracket to be simultaneously lifted and turned, which will not happen unintentionally when the mounted object is being removed by lifting it.

The angle referred to may be within the range of 30°–60° and is preferably 45°.

Preferably, the first opening portion is bounded in vertical direction by substantially horizontal bounding portions, the vertical distance between them being only slightly larger than the vertical dimension of the connecting portion of the bracket.

Accordingly, the vertical dimension of the second bracket portion is permitted to be smaller than in the known bracket, which in turn permits the second opening portion to have a correspondingly smaller dimension. The vertical size of the mounting opening as a whole is further reduced in virtue of the fact that the second opening portion only needs to allow the second bracket portion to pass in a non-vertical position.

The invention further relates to a supporting part and a bracket, evidently intended to be used in a storage system according to the invention.

It is observed that a storage system is known per se in which the bracket cannot be unintentionally removed while an object supported by the bracket is being removed. This known bracket comprises flat portions and portions where the bracket is bent over in a direction perpendicular to the flat portions. This complicated form cannot without further treatment be manufactured from one plate through punching, for example, and, further, the mounting opening is relatively large. Moreover, the procedure of mounting such a bracket in such a mounting opening is rather complicated. A further disadvantage is that this known per se bracket can only be used for supporting objects and cannot be used for secure attachment.

It is further observed that a system for connecting two parts, in particular two tent posts, is known per se from international patent application WO 88/02446. In the two parts mounting openings are provided each comprising two opening portions: a vertically directed operative opening and an obliquely directed insertion opening. A support member is mounted by inserting it into the insertion opening and then bringing it into the operative position by a turning movement. This sytem, however, cannot be compared with a system according to the present invention. In the first place a support member of this known system is not a flat bracket which can easily be manufactured from a flat plate or strip, for example by punching. In the second place a support member of this known system is not suitable for directly positioning an object such as a shelf relatively to a supporting part, and thus a connecting member (13) has to be mounted. The connecting member serves to prevent the support members from rotating undesirably as a result of which they might come loose. Only when the connecting member has been mounted can an object such as a shelf be supported on it. Such a connecting member renders the known system relatively expensive and complicated. Further, means have to be provided to prevent the connecting member from being lifted unintentionally. To that effect a bore has to be provided in a support member, and corresponding holes have to be provided in the connecting member for receiving a pin to be mounted for locking the connecting member relatively to the support members.

A further drawback of the known system is that to enable a connecting member to be mounted, the two parts — posts — have to be positioned opposite each other with the respective mounting openings aligned and directed towards each other. To prevent the possibility that two support members along with a connecting member connected to them rotate as one whole, the respective mounting openings have to be oppositely directed.

A further drawback of the known system is that due to the relatively large size of the block-shaped support member, a relatively large moment is exerted on the support member, as a result of which the support member exerts a relatively large reactive force on the posts, which may become distorted as a result.

Yet another drawback of the known system is that the insertion opening and the operative opening of the mounting opening are centred, which complicates the mounting of a support member in that the support member has to be rotated very accurately. A slight deviation relative to the operative position is sufficient for the support member to drop from the operative position to the insertion position.

To further explain the invention one embodiment of the system according to the invention will now be described, by way of example, with reference to the accompanying drawings, in which FIG. 1 is a partial front view of a preferred embodiment of a supporting part of the storage system according to the invention;

Figure 1:
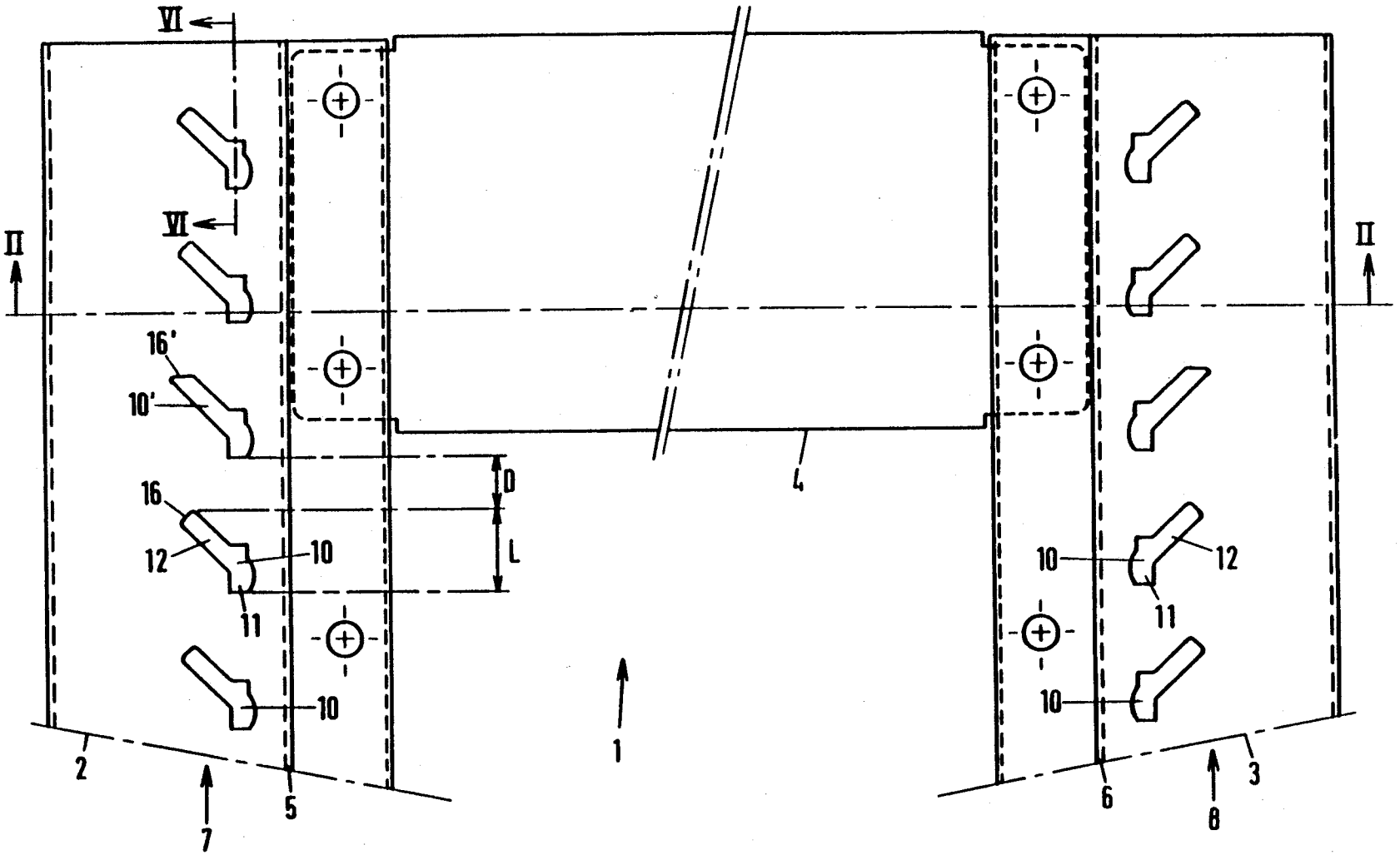
Figure 4A:
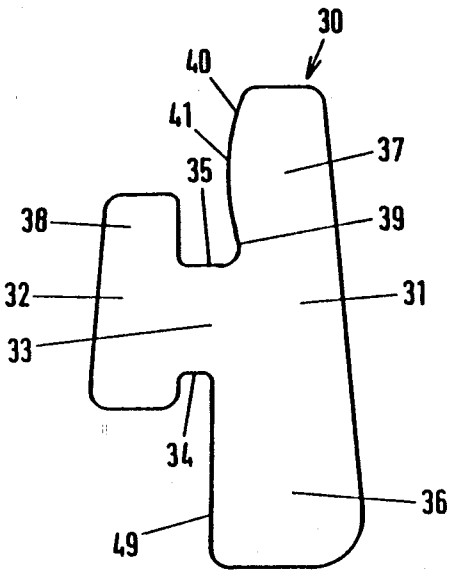
Figure 4B:
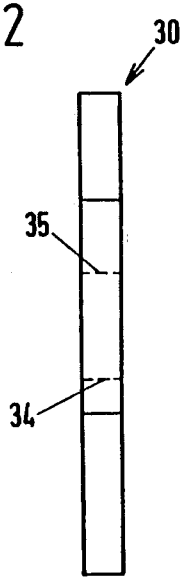
Figure 3:
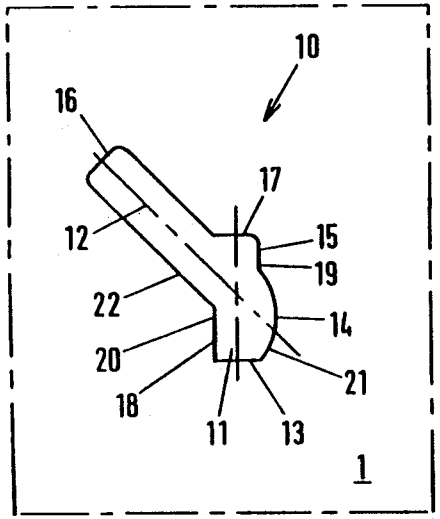
FIG. 3 shows a mounting opening according to the invention to an enlarged scale.
Figure 6:
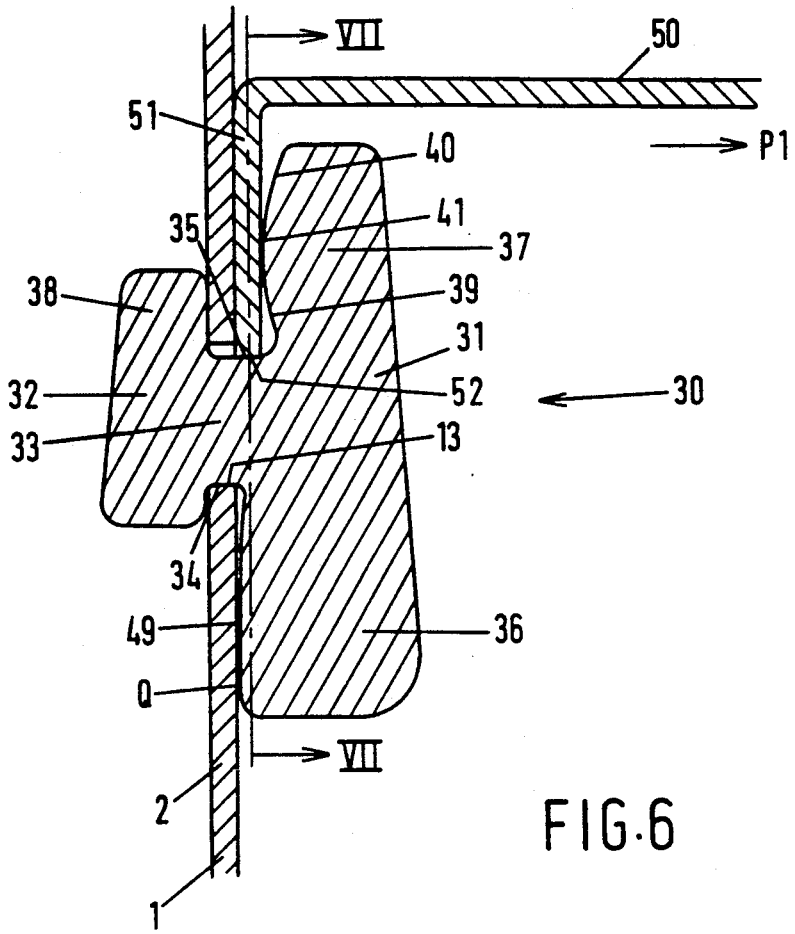
Figure 7:
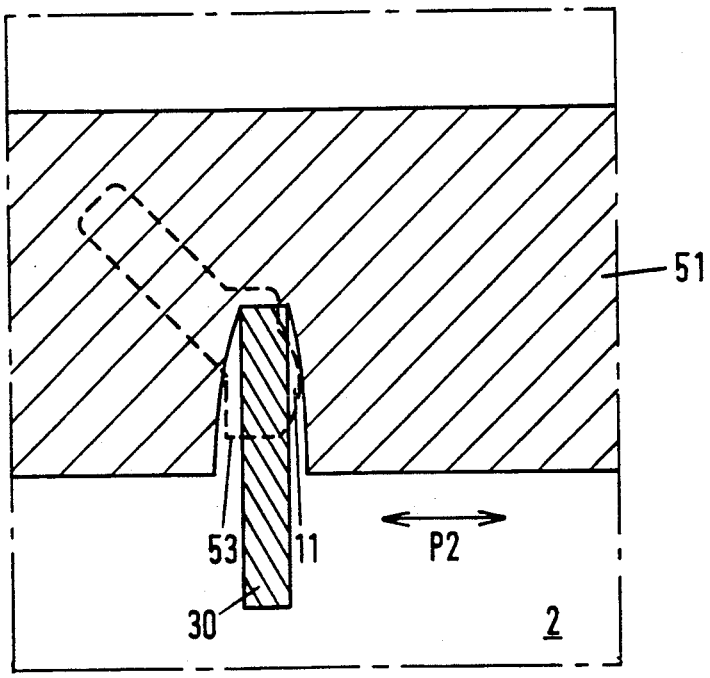

FIGS. 4A-B show views of a bracket according to the invention;

FIGS. 5A-D show successive steps of mounting the bracket of FIG. 4 in the mounting opening of FIG. 3;

FIG. 6 shows a cross-sectional view, taken on the line VI-VI of FIG. 1, of the supporting part of FIG. 3 and an object mounted on the supporting part through the bracket of FIG. 4;

FIG. 7 shows a cross-sectional view of the mounting bracket and the mounted object, taken on the line VII--VII of FIG. 6.

Figure 2:
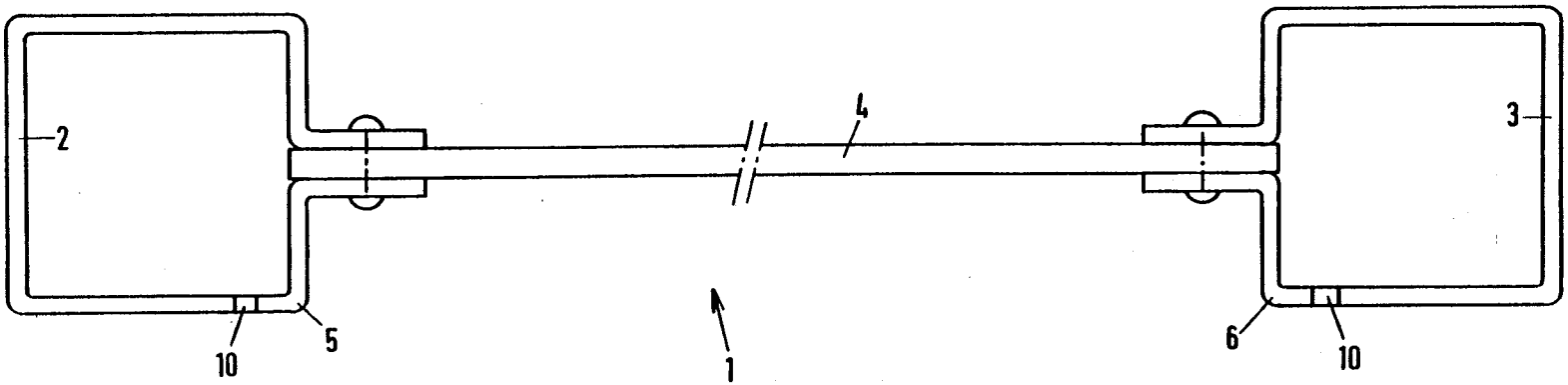
FIG. 2 is a cross-sectional view of the supporting part taken on the line II—II of FIG. 1.

FIGS. 1 and 2 show a preferred embodiment of a supporting part according to the invention, generally designated by the reference numeral 1. The supporting part 1 comprises two columns 2, 3 interconnected in known per se manner by means of cross-connection parts 4. Provided in the columns 2, 3 are vertical rows 7, 8 of mounting openings 10 according to the invention. The mounting openings 10 have a first opening portion 11 and a second opening portion 12, partly overlapping each other, and are provided in the vicinity of a bent-over portion 5, 6 of the columns 2, 3, the second opening portion 12 being away from the bent-over portion 5, 6, the mounting openings 10 being provided in the column 2 in mirror-symmetrical relationship relative to the mounting openings 10 in column 3. Because the direction of the second opening portion 12 makes an angle with the first opening portion 11, the total vertical size L of the mounting opening 10 is reduced, so that when the distance D between the respective mounting openings 10 remains the same, the pitch distance L+D is reduced, which improves the flexibility of the storage system according to the invention. Furthermore, the end 16 of the second opening portion 12, which end is away from the bent-over portion 5, 6, is situated in a more tension-neutral portion of the column 2, 3, thus weakening the supporting part 1 as little as possible.

In the embodiment shown some mounting openings 10′ are provided that have a differently shaped end 16′. When, for example, each fifth mounting opening is of different shape 16′, this will facilitate counting the mounting openings when mounting the brackets.

FIG. 3 shows a mounting opening 10 to an enlarged scale. The mounting opening 10 is suitable for cooperation with a preferred embodiment of a bracket according to the invention, in FIG. 4 generally designated by reference numeral 30. The bracket 30 has a flat shape, as can be seen in FIG. 4B, and can thus be easily manufactured from a flat plate or strip, for example by punching, without additional treatment. The bracket 30 comprises a first bracket portion 31, which serves to be connected to an object to be mounted (not shown); a second bracket portion 32, which serves to be arranged in the operative position on the side of the supporting part 1 that is away from the object; and a connecting part 33, which connects the first bracket portion 31 and the second bracket portion 32 to each other.

With reference to FIG. 5 it will now be further explained how the bracket 30 is mounted in the mounting opening 10. The second bracket portion 32 is inserted through the second opening portion 12 of the mounting opening 10 (FIG. 5A) so far that the connecting portion 33 of the bracket 30 is in the second opening portion 12 (FIG. 5B). The second bracket portion 32 and the first bracket portion 31 will then be on opposite sides of the supporting part, outside of the mounting opening 10, and the bracket 30 can be slid within the second opening portion 12 in the direction of the first opening portion 11 (FIG. 5C). Finally, the connecting portion 33 of the bracket 30 is wholly moved into the first opening portion 11 (FIG. 5D) by imparting to the bracket 30 a combined turning and downwardly directed sliding movement, the lower edge 34 of the connecting portion 33 of the bracket 30 resting on the substantially horizontal lower edge 13 of the first opening portion 11. As shown in FIG. 5D, the shape and the size of the first opening portion 11 substantially correspond to those of the connecting portion 33 of the bracket 30, with the understanding that there is sufficient clearance for the connecting portion 33 to move within the mounting opening 10, the turning of the connecting portion 33 in the mounting opening 10 being facilitated by a projecting portion 14, which may be arcuate as shown, provided in the side 15 of the first opening portion 12 that is away from the second opening portion 12. In the operative position of the bracket 30 in the mounting opening 10, as shown in FIG. 5D, the bracket 30 has only a slight degree of vertical clearance in the mounting opening 10, because the vertical dimension of the first opening portion (11) is only slightly larger than the vertical dimension of the connecting portion 33 of the bracket 30. When an object that is mounted on the supporting part 1 through the bracket 30 is lifted by means of un upward movement, the bracket 30 cannot be lifted by the object further than the aforementioned slight vertical clearance allows, i.e. up to the point where the upper edge 35 of the connecting portion 33 of the bracket 30 abuts the substantially horizontal upper edge 17 of the first opening portion 11. In this position, however, the bracket 30 cannot be moved out of the mounting opening 10, so that the bracket 30 is prevented from being unintentionally removed from the mounting opening 10 when, for example, the object is being removed. The bracket 30 can only be removed from the mounting opening 10 by repeating in reverse order the movements described hereinbefore with reference to FIGS. 5A–D, and that requires conscious action.

Figure 5A:
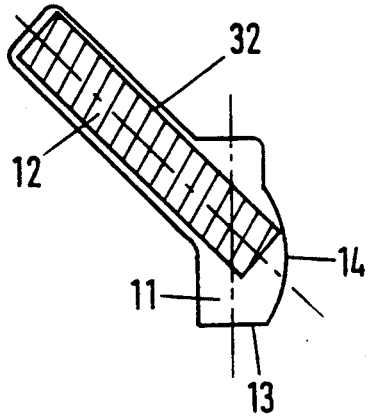
Figure 5B:
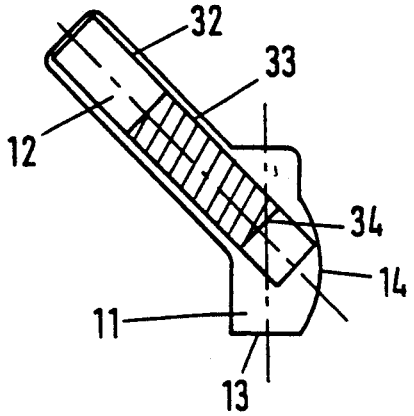
Figure 5C:
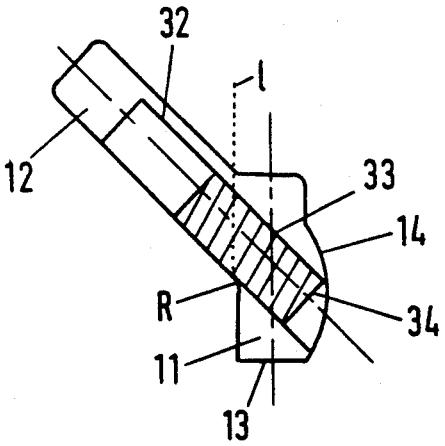
Figure 5D:
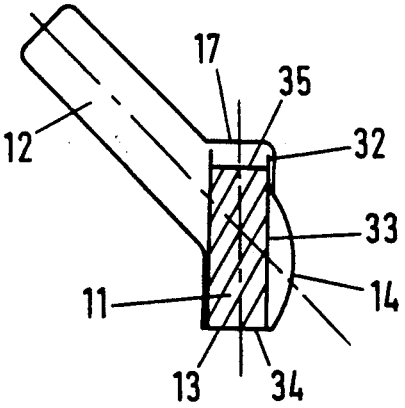

In the operative position of the bracket 30, in which the lower edge 34 of the connecting portion 33 of the bracket 30 rests on the lower edge 13 of the first opening portion 11, undesirable tilting of the bracket 30, which would adversely affect the stability of the storage system, is avoided, on the one hand, by the cooperation of the border portion 20 extending vertically upwards from the lower edge 13 of the first opening portion 11 on the side 18 of the first opening portion that is directed towards the second opening portion 12, and the border portion 19 extending vertically downwards from the upper edge 17 of the first opening portion on the side 15 of the first opening portion 11 that is directed away from the second opening portion 12, and, on the other, by the cooperation of said border portion 20 and the border portion 21 of said projecting border portion 14, extending obliquely upwards from the lower edge 13 of the first opening portion 11. At some distance from the lower edge 13 of the first opening portion 11 the border portion 20 adjoins an obliquely extending lower edge portion 22 of the second opening portion 12 at a point of transition. As a result, the bracket 30, in the position shown in FIG. 5B, will tend to move towards the position shown in FIG. 5C due to the force of gravity. In FIG. 5C an auxiliary vertical line 1 is drawn through the point R on the lower edge portion 22 of the second opening portion 12, which point is the last point of contact with the bracket 30. The size of the lower part 36 of the first bracket portion 31 is such that the centre of gravity of the bracket 30 in the position shown in FIG. 5C is on the side of the auxiliary line 1 that is directed to the first opening portion 11. Due to this, the bracket 30, in the position shown in FIG. 5C, will tend to move to the position shown in FIG. 5D under the influence of the force of gravity. Thus it is made easier for the user to mount brackets 30, because, on the one hand, the large lower part 36 renders the bracket 30 easy to handle, and, on the other, after inserting the bracket 30 in the insertion position in the second opening portion 12, the bracket 30 will tend to move into the operative position of its own accord.

FIG. 6 shows a cross-section of an object mounted on a supporting part 1 through a bracket 30, the object being a shelf 50 in the example shown. The shelf 50 has a vertical engagement portion 51 arranged between the supporting part 1 and the upper part 37 of the first bracket portion 31, the lower edge 52 of the engagement portion 51 resting on the upper edge 35 of the connecting portion 33 of the bracket 30. The bracket 30 is in the operative position shown in FIG. 5D, the lower edge 34 of the connecting portion 33 of the bracket 30 resting on the lower edge 13 of the first opening portion 11. The moment exerted by the shelf 50 on the bracket 30 — which is relatively small because the horizontal distance between the aforementioned locations of support is at most equal to the combined thickness of the column 2, 3 of the supporting part 1 and the thickness of the engagement portion 51 of the shelf 50 — is compensated because the upper part 38 of the second bracket portion 32 and the lower part 36 of the first bracket portion 31, abut the column 2, 3 of the supporting part 1 on opposite sides. To ensure the lateral forces thus exerted on the column 2, 3 are as small as possible, the shape of the edge 49 of the lower part 36 of the first bracket portion 31 on the side of the connecting portion 33 is such that the point of contact Q of the lower part 36 of the first bracket portion 31 is removed as far as possible from the lower edge 34 of the connecting portion 33, the arm of the compensatory moment thus being as large as possible. At 39 a recess is provided in the upper part 37 of the first bracket portion 31 for receiving any burr possibly present on the lower edge 52 of the engagement portion 51 of the shelf 50. At 40 the upper part 37 of the first bracket portion 31 is slightly curved to permit the shelf 50 to bend when it is heavily loaded, so that the engagement portion 51 is allowed to move towards the bracket 30 without being distorted, which would result in a wedged connection hard to undo. At 41 the bracket 30 abuts the engagement portion 51 of the shelf 50, so as to avoid the possibility of the shelf 50 of supporting part 1 being displaced in the direction P1.

As shown in FIG. 7, the engagement portion 51 of the shelf 50 may be provided with a recess 53 corresponding with the bracket 30, so as to avoid the possibility of the shelf 50 being displaced along supporting part 1 in the direction P2.

Many variations and modifications of the embodiment of the storage system according to the invention shown will readily occur to a person skilled in the art without departure from the inventive idea or the scope of the protection. Thus it is possible for the mounting openings to have rounded corners. It is also possible for the vertical border portion 20 of the first opening portion 11 to gradually merge with the oblique lower edge portion 22 of the second opening portion 12, and/or for the lower edge portion 22 to be at least in part convexly curved so as to facilitate the transition of the connecting portion 33 of the bracket 30 from the second opening portion 12 into the first opening portion 11.

Further, it is possible for the first bracket portion not to extend above the connecting portion, for example when shelves are involved that do not have vertical engagement portions but merely rest on the brackets. Such will be the case when, for example, the shelves are not intended for heavy loading and, accordingly, need not be held down to avoid displacement in the direction P1 referred to.

It will also be clear the invention is not limited to a supporting part and two columns. For certain applications supporting parts will be used where at one given height one mounting opening is provided, and it will be clear it is also possible for a plurality of mounting openings to be provided at the same height in the supporting part.

What I claim is:

1. A mountable storage system, comprising:

at least one supporting part in which a plurality of mounting openings are provided at predetermined locations;

at least one flat bracket adapted to be positioned in a mounting opening, said bracket comprising at least:

a first bracket portion, which serves to support an object to be positioned relatively to said supporting part;

a second bracket portion, which is arranged in the operative position on the side of the vertical supporting part away from the vertical supporting part; and a connecting portion, which connects the first bracket portion and the second bracket portion to each other;

characterized in that a mounting opening (10) has at least two opening portions (11, 12), the first opening portion (11) serving to receive in the operative position the connecting portion (33) of the bracket (30) and having such shape and size that the bracket (30) has only slight vertical clearance in the operative position, and the second opening portion (12) being suitable for allowing the second bracket portion (32) to pass in an insertion position, the bracket (30) in the insertion position making an angle with the position of the bracket (30) in the operative position.

2. A storage system according to claim 1, characterized in that said angle is in the range of 30°–60°.

3. A storage system according to claim 1, characterized in that said angle is substantially equal to 45°.

4. A storage system according to claim 1, characterized in that the first opening portion (11) is bounded in vertical direction by substantially horizontal bounding portions (13, 17), the vertical distance between said bounding portions being only slightly larger than the vertical dimension of the connecting portion (33) of the bracket (30).

5. A storage system according to claim 1, characterized in that the side (15) of the first opening portion (11) that is away from the second opening portion (12) has a projecting portion (14).

6. A storage system according to claim 5, characterized in that the projecting part (14) is of arcuate configuration.

7. A storage system according to claim 1, characterized in that the first opening portion (11) adjoins the second opening portion (12) at a point of transition at some distance from the lower edge (13) of the first opening portion (11).

8. A storage system according to claim 7, characterized in that the lower boundary of the second opening portion (22), adjacent to the point of transition extends obliquely or convexly.

9. A storage system according to claim 7, characterized in that the bracket (30) is of such configuration that in the position taken by the bracket (30) after it has moved from the second opening portion (12) into the first opening portion (11), the centre of gravity of the bracket (30) is next to the transition point, on the side of the first opening portion (11).

10. A storage system according to claim 9, characterized in that the lower part (36) of the first bracket portion (31) is larger than the upper part (37) of the first bracket portion (31).

11. A storage system according to claim 1, in which a supporting part comprises a bent-over portion, characterized in that the mounting openings (10) have their first opening portion (11) provided in the vicinity of the bent-over portion (5, 6) and the second opening portion (12) is away from the bent-over portion (5, 6).

12. A storage system according to claim 1, in which a supporting part for mounting an object has at least two vertical rows of mounting openings provided in it, characterized in that the mounting openings (10) of one row (7) are arranged in mirror-symmetrical relationship relative to the mounting openings (10) of the second row (8).

13. A supporting part for use with a mountable storage system having at least one flat bracket adapted to be positioned in a mounting opening, the bracket comprising at least a first bracket portion, a second bracket portion, and a connecting portion which connects the first bracket portion and the second bracket portion to each other, the supporting part comprising:

at least one vertical member;

a plurality of mounting openings provided in said member, each of said mounting openings having at least two opening portions;

said first opening portion serving to receive in an operative position the connecting portion of the bracket, said first opening portion having such shape and size that the bracket has only slight vertical clearance in the operative position, the first bracket portion in the operative position serving to support an object to be positioned relative to the supporting part and the second bracket portion in the operative position being on an opposite side of the vertical member from the first bracket portion; and said second opening portion being suitable for allowing the second bracket portion to pass in an insertion position, the bracket in the insertion position making an angle with the position of the bracket in the operative position.

14. A bracket for use in a mountable storage system having at least one supporting part in which a plurality of mounting openings are provided at predetermined locations, each of the mounting openings having a first opening portion and a second opening portion, said bracket being flat and adapted to be positioned in one of the mounting openings, said bracket further comprising:

at least a first bracket portion, which serves to support an object to be positioned relative to the supporting part when said bracket is in an operative position, a second bracket portion, which is arranged in the operative position on a side of the vertical supporting part away from said first bracket portion, said second bracket portion being sized to pass in an insertion position through the second opening portion, said bracket in the insertion position making an angle with the position of said bracket in the operative position, and a connecting portion which connects said first bracket portion and said second bracket portion to each other, said connecting portion sized to fit in the first opening portion with only slight vertical clearance when said bracket is in the operative position.

* * * * *